US005769730A

United States Patent [19]

Haskell

[11] Patent Number: 5,769,730

[45] Date of Patent: Jun. 23, 1998

[54] BOWLING BALL FINGERTIP POSITIONER

[76] Inventor: Roger Haskell, 25246 106th Ave. SE., Apt. A-106, Kent, Wash. 98031

[21] Appl. No.: 353,083

[22] Filed: Dec. 9, 1994

[51] Int. Cl.[6] ..... A63B 37/00

[52] U.S. Cl. ..... 473/128; 473/130

[58] Field of Search ..... 473/61, 127, 128, 473/129, 130; 2/21

[56] References Cited

U.S. PATENT DOCUMENTS

| | | | |
|---|---|---|---|
| 2,708,578 | 5/1955 | Mitchell | 473/130 |
| 2,712,160 | 7/1955 | Sterczek | 18/55.05 |
| 2,968,484 | 1/1961 | Vincent | 473/130 |
| 2,983,511 | 5/1961 | Stott | 473/130 |
| 3,113,775 | 12/1963 | Taylor | 473/130 |
| 3,342,488 | 9/1967 | Novatnak | 273/63 |
| 4,371,163 | 2/1983 | Shaffer et al. | 273/54 |
| 4,381,863 | 5/1983 | Norman | 273/63 |
| 4,530,502 | 7/1985 | Yamane | 473/128 |
| 4,569,520 | 2/1986 | Yamane | 273/63 |
| 5,261,660 | 11/1993 | Rowland | 473/130 |

*Primary Examiner*—William M. Pierce

*Attorney, Agent, or Firm*—Teresa J. Wiant; Glenn D. Bellamy

[57] ABSTRACT

The present invention provides an improved bowling ball and an insert for a bowling ball for use in a finger hole of a bowling ball. According to the present invention, a fingertip positioner in a finger hole of a bowling ball positions the pad of the finger against the interior wall of the finger hole closest to the thumb hole in the bowling ball.

8 Claims, 2 Drawing Sheets

BOWLING BALL FINGERTIP POSITIONER

TECHNICAL FIELD

This invention relates to a bowling ball fingertip positioner for positioning the fingertip of a bowler in a bowling ball during the bowler's swing. More particularly, this invention relates to a bowling ball fingertip positioner for positioning a pad of a fingertip against an interior wall of a finger hole in a bowling ball.

BACKGROUND OF THE INVENTION

When bowling with a fingertip bowling ball, proper positioning of the bowler's fingertips in the finger holes improves the accuracy with which the bowler delivers and releases the bowling ball during his swing. Many prior art devices have attempted to properly position a bowler's fingers or thumb within a bowling ball. For example, a bowling ball with individualized finger and thumb holes is disclosed in U.S. Pat. No. 2,712,160, granted Feb. 21, 1951, to W. L. Sterczek. Inserts for thumb holes in bowling balls are disclosed in U.S. Pat. No. 4,569,520, granted Feb. 11, 1986, to Jimmie F. Yamane; U.S. Pat. No. 4,530,502, granted Jul. 23, 1985, to Jimmie F. Yamane; and U.S. Pat. No. 3,342,488, granted Sep. 19, 1967, G. F. Novatnak. U.S. Pat. No. 4,381,863 ('863), granted May 3, 1983, to Bill Norman discloses a finger hole insert for a bowling ball which includes a ridge protruding from an upper portion of a finger hole. In use, the pad of the fingertip rests against the ridge in the device disclosed in the '863 patent. Consequently, the pad of the fingertip inserted is tilted away from the interior wall of the finger hole by the ridge.

SUMMARY OF THE INVENTION

The present invention provides a bowling ball for positioning a finger in a finger hole. The bowling ball comprises a finger hole and a fingertip positioner. The finger hole is substantially cylindrical and has an interior wall and a length sufficient to receive a fingertip portion of a finger. The fingertip portion comprises the portion of a finger from the first knuckle to the end of the finger, including the fingernail. The fingertip positioner protrudes into the finger hole an amount sufficient to position a finger to grip the bowling ball with the pad of the finger pressed against the interior wall of the finger hole when the finger is positioned in said finger hole with the fingernail of the finger in a contacting relationship with the fingertip positioner. In use, the fingertip portion of a finger is placed in the finger hole with the fingernail of the finger in contacting relationship with the fingertip positioner such that the pad of the finger is positioned to grip the interior wall of the finger hole.

In a preferred form of the invention, the fingertip positioner has a length, width and thickness such that when the fingertip portion of the finger is positioned in the finger hole, only the fingernail is positioned against the fingertip positioner and the fingertip portion of the finger not including the fingernail is out of contact with the fingertip positioner. Preferably, the fingertip positioner is adhered to the interior wall of the finger hole by an adhesive. It is also preferred that the fingertip positioner substantially comprises rubber.

The present invention also includes an insert for providing a fingertip positioner in a bowling ball having a finger hole. The insert comprises a substantially flexible body, a fingernail receiving surface, and a bonding surface. The bonding surface is opposite the fingernail receiving surface. The fingernail receiving surface is sized for contacting a fingernail of a finger without contacting the remainder of the finger. In use, the insert is positioned in a finger hole of a bowling ball with the bonding surface against an interior wall of the finger hole such that when a fingertip portion of a finger is inserted in the finger hole, the fingernail is in contacting relationship with the insert to position the finger for pressing against a portion of the interior wall of the finger hole closest to the thumb hole. Preferably, the bonding surface includes a adhesive layer for adhering the insert to an interior wall of a finger hole in a bowling ball. It is also preferred that the body of the insert substantially comprises rubber.

These and other advantages and features will become apparent from the detailed description of the best mode for carrying out the invention that follows.

BRIEF DESCRIPTION OF THE DRAWINGS

Like reference numerals are used to denote like parts throughout the several figures of the drawings, and.

BEST MODE FOR CARRYING OUT THE INVENTION

Figure 1:
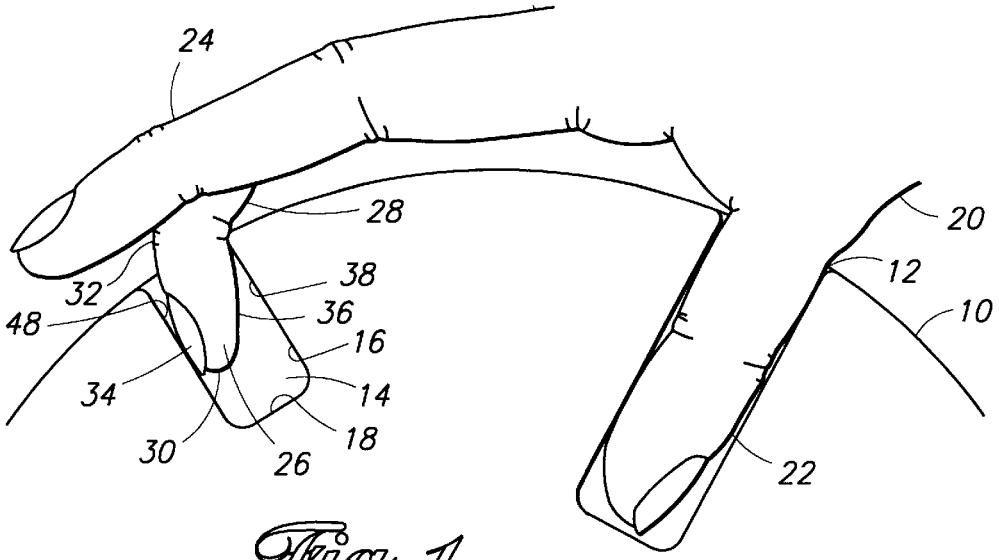
Fig 1 Prior Art
FIG. 1 is a pictorial, partial cut-away view of a bowler's finger and thumb within a prior art bowling ball which does not incorporate the present invention.

The present invention provides an improved bowling ball and an insert for a bowling ball for properly positioning a bowler's fingertip in a finger hole. Referring first to the prior art bowling ball as shown in FIG. 1, the fingertip bowling ball 10 includes a thumb hole 12 and a pair of finger holes 14, only one of which is shown. Both the thumb hole 12 and the finger hole 14 are substantially cylindrical. The finger hole 14 includes an interior wall 16 and a bottom wall 18. In use, a bowler positions his hand 20 such that his thumb 22 extends into the thumb hole 12, his index finger 24 extends across the top of the bowling ball 10 and a fingertip portion 26 of his middle finger 28 extends into the finger hole 14. The fingertip portion 26 includes the portion of the finger 28 from the end 30 of the finger to the first knuckle 32, including the fingernail 34. To accurately control the bowling ball 10 during delivery and release., it is preferred that the pad 36 of the finger 28 is pressed against a portion 38 of the interior wall 16 closest to the thumb hole 12. If the pad 36 of the finger 28 is out of contact with the interior wall portion 38, the bowler has less control over the delivery and release of the bowling ball 10 during his swing.

The present invention provides an insert for a bowling ball 10 for positioning a finger 28 in a finger hole 14 of a fingertip bowling ball 10. Referring to FIGS. 2–5, the present invention provides a fingertip positioner 40 for use in a bowling ball 10 for properly positioning the finger 28 to grip the bowling ball 10, with the pad 36 of the finger 28 against a portion 38 of the interior wall 16 closest to the thumb hole 12. The fingertip positioner 40 includes a substantially flexible body 42, a fingernail-receiving surface 44, and a bonding surface 46 opposite the fingernail-receiving surface 44. Preferably, the flexible body 42 is made of gum rubber or the like. This material provides an adequately flexible, firm but somewhat resilient body with desirable frictional surface characteristics.

In a preferred form of the invention, the fingertip positioner 40 further includes rounded or clipped corners 48 having angles of less than 90°. It is also preferred that the rounded or clipped corners 48 are on all four corners of the fingertip positioner 40 so that the fingertip positioner 40 can be installed with either of the shorter sides towards the surface 56 of the bowling ball 10. In yet another preferred form of the invention, the fingertip positioner 40 has a length 50 which is as long or longer than the fingernail 34 of the finger 28. The bonding surface 46 may include an adhesive layer.

The fingertip positioner 40 is installed in a finger hole 14 on a portion 38 of the interior wall 16 furthest away from the thumb hole 12 and opposite the portion 38 of the interior wall 16 for receiving the pad 36 of the finger 28. The fingertip positioner 40 is installed at a distance 54 below the surface 56 of the bowling ball 10. Preferably, the distance 54 is substantially equal to the distance from the first knuckle 32 of the bowler's finger 28 to, but not including, the fingernail 34 of the bowler. The fingertip positioner 40 is installed in the finger hole 14 such that when the bowler's fingertip portion 26 is inserted into the finger hole 14, the fingernail 34 is in contacting relationship with the fingertip positioner 40 and the remainder of the fingertip portion 26 is out of contact with the fingertip positioner 40. The fingertip positioner 40 protrudes into the finger hole 14 an amount sufficient to permit the bowler's fingertip portion 26 to be easily inserted and withdrawn from the finger hole, yet prohibiting the fingertip portion 26 from substantially tipping away from the interior wall portion 38. The thickness of the fingertip positioner 40 may be varied as necessary to provide the most desirable fit.

Figure 2:
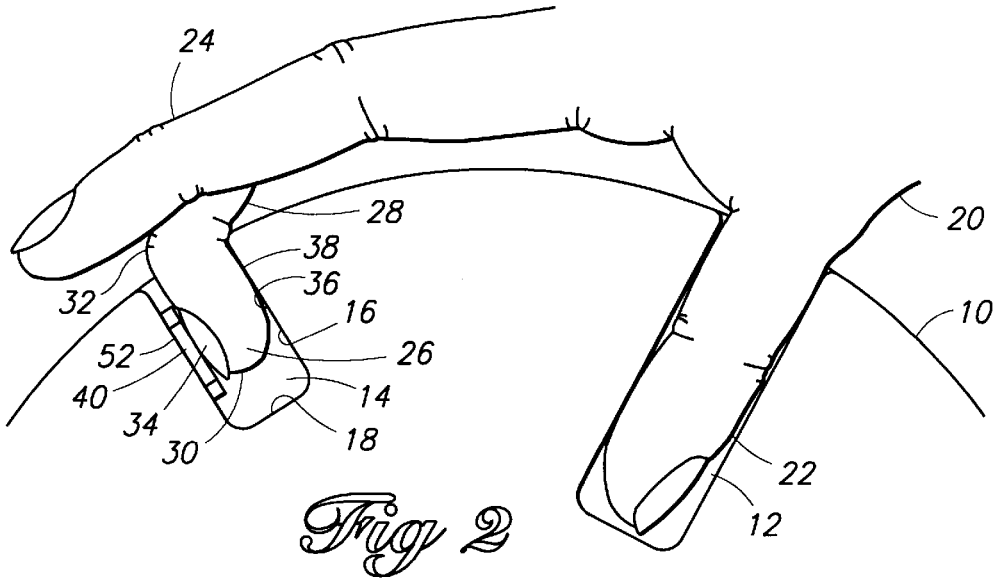
FIG. 2 is a pictorial, partial cut-away view of a bowler's fingertip and thumb within a finger hole and thumb hole in a bowling ball which incorporates the positioner of the present invention.
Figure 5:
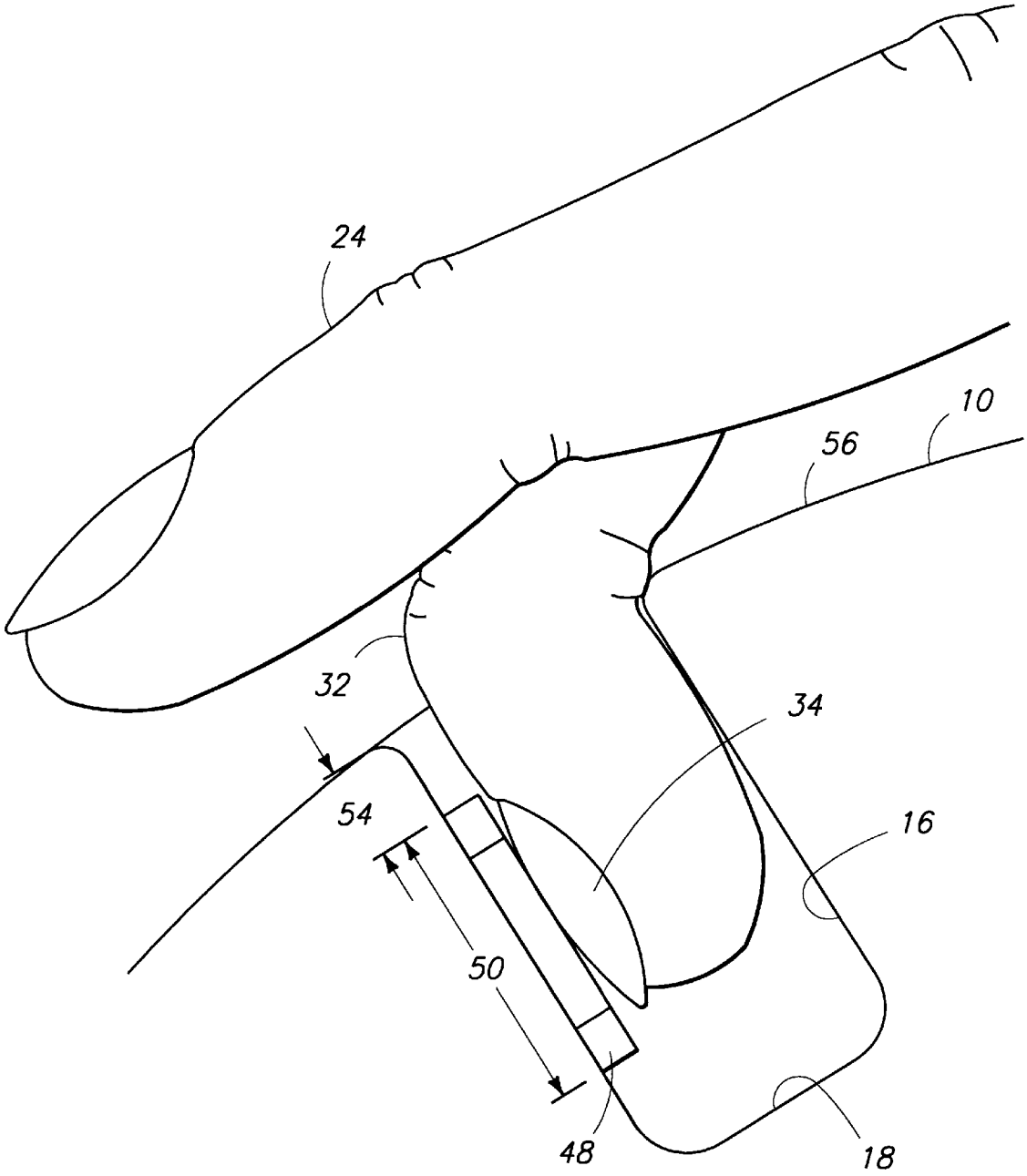
FIG. 5 is an enlarged view of the finger hole and finger as shown in FIG. 2.

In use, the bowler inserts his thumb 22 into the thumb hole 12 with his thumb 22 pressed against the interior wall of the thumb hole 12, toward the finger hole 14. The bowler inserts the fingertip portion 26 of his middle finger 28 into the finger hole 14 with his fingernail 34 in contacting relationship with the fingertip positioner 40 (and likewise with the bowler's ring finger, not shown). The index finger 24 of the bowler is stretched across the surface 56 of the bowling ball 10. The fingertip positioner 40 positions the finger 28 by inhibiting the movement of the finger 28 away from the interior wall portion 38 such that the bowler's finger 28 is aligned to press against the interior wall portion 38 with the finger pad 36, as shown in FIG. 2. The bowler can then grip the bowling ball 10 by pressing against the interior wall portion 38 of the finger hole 14 with the pad 36 of his finger 28 and against the interior wall portion 52 of the thumb hole 12 with his thumb 22 during his delivery. Upon release, his finger 28 and thumb 22 are withdrawn from the finger hole 14 and thumb hole 12, respectively, without the fingertip positioner 40 causing difficulty in removing his fingertip portion 26 of his finger 28 from the finger hole 14. Grip between the pad 36 and interior of the hole 16 is enhanced, thereby increasing the bowler's control of the ball 10.

Figure 4:
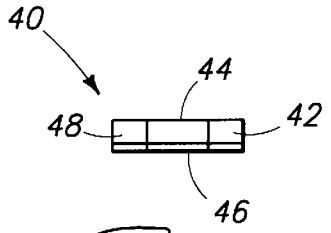
FIG. 4 is an elevational cross-sectional view of the positioner of the present invention.
Figure 3:
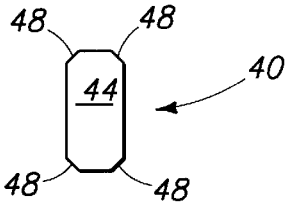
FIG. 3 is a top plan view of the positioner of the present invention.

The present invention also provides an improved bowling ball for positioning a bowler's finger in the bowling ball 10. The improved bowling ball may be formed by the addition of an insertable fingertip positioner 40, as illustrated in FIGS. 3 and 4, to a fingertip bowling ball 10. Alternatively, the fingertip positioner 40 may be formed by milling or drilling of the finger hole 14 to include a raised portion or protrusion on the interior wall 16. Regardless of how the bowling ball 10 is adapted or formed to include the fingertip positioner, such positioner will function to position the finger as described above for the insert.

The present invention permits a bowler to customize a bowling ball with a fingertip positioner. Since the dimensions of each bowler's fingers are unique, it is preferred that the fingertip positioner is sized specifically for each bowler. The length of the positioner may vary from one bowler to another, as may the width and rounded corners. In addition the location of the positioner on the interior wall of the finger hole may vary depending upon the length of the fingertip portion of each bowler's finger.

In a preferred form of the invention, the positioner is formed as an insert and comprises a body of flexible rubber. Adjustments for the dimensions of the bowler's finger may be made before the positioner is installed by cutting the insertable positioner to fit the dimensions of the bowler's finger. Once the positioner is properly sized, the positioner may be installed at the appropriate location on the interior wall of the finger hole for the specific dimensions of the bowler's finger. The proper sizing and placement of the positioner in the other finger hole would follow the general guidelines for the positioner for the middle finger, as described above.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. A bowling ball for positioning a finger in a finger hole; comprising:

substantially cylindrical finger hole having an interior wall and a length adapted to receive a fingertip portion of a finger, said fingertip portion comprising the portion of a finger from the first knuckle to the end of the finger, including a fingernail and finger pad portion; and a fingertip positioner means protruding into said finger hole and adapted to position a finger to grip said bowling ball with the pad portion of said finger pressed against said interior wall of the finger hole when the finger is positioned in said finger hole with the fingernail of the finger in contacting relationship with the fingertip positioner, wherein in use, the fingertip portion of a finger is placed in said finger hole with the fingernail of said finger in contacting relationship with said fingertip positioner such that said pad portion of said finger is positioned to grip the interior wall of the finger hole.

2. A bowling ball according to claim 1, wherein said fingertip positioner has a length and width such that when the fingertip portion of the finger is positioned in said finger hole, only said fingernail is positioned against said fingertip positioner and fingertip portion of the finger not including the fingernail is out of contact with the fingertip positioner, wherein, in use, said fingertip portion of said finger is positioned in said finger hole with the fingernail of said finger in contacting relationship with said fingertip positioner and said fingertip portion between the first knuckle and the end of the finger is out of contact with the fingertip positioner and the pad portion of said finger is positioned to grip the interior wall of the finger hole.

3. The bowling ball of claim 1, wherein said fingertip positioner is adhered to said interior wall of said finger hole by an adhesive.

4. The bowling ball of claim 3, wherein said fingertip positioner is made substantially of rubber.

5. An insert for providing a fingertip positioner in a bowling ball having a finger hole, comprising:

a substantially flexible body;

a fingernail receiving surface adapted for contacting a fingernail of a finger without contacting the remainder of the finger; and bonding surface opposite the fingernail receiving surface, wherein said insert is positioned in a finger hole of a bowling ball with said bonding surface against an interior wall of the finger hole such that when a fingertip portion of a finger is inserted in said finger hole, said fingernail is in contacting relationship with the insert to position the finger for pressing against a portion of the interior wall of the finger hole closest to the thumb hole.

6. The insert according to claim 5, wherein said bonding surface includes a adhesive layer for adhering said insert to an interior wall of a finger hole in a bowling ball.

7. The insert of claim 5, wherein said body is made substantially of rubber.

8. A fingertip positioner for use in a finger hole of a bowling ball, said finger hole being substantially cylindrical with an interior wall and a bottom wall adapted to receive a fingertip portion of a finger, said fingertip portion comprising the portion of a finger from the first knuckle to the end of the finger, including the fingernail, said fingertip positioner comprising:

a protrusion positioned in the interior wall toward the bottom wall in said finger hole, said protrusion adapted to bear against a fingernail of a finger and thereby press an opposite pad portion of the finger against an opposite portion of the interior wall of the finger hole, whereby in use, the fingertip portion of a finger is maintained in proper position to provide enhanced grip between the fingertip pad portion and the interior wall.

* * * * *